United States Patent [19]

Meisenheimer, Jr.

[11] 4,032,733

[45] June 28, 1977

[54] OMNIDIRECTIONAL INERTIA SWITCH

[76] Inventor: Daniel Thomas Meisenheimer, Jr., 404 Longmeadow Road, Orange, Conn. 06477

[22] Filed: Oct. 6, 1975

[21] Appl. No.: 620,064

[52] U.S. Cl. ..... 200/61.45 R; 73/517 R; 102/70.2 R

[51] Int. Cl.[2] ..... H01H 35/14

[58] Field of Search ..... 200/61.45–61.53; 102/70.2 R; 340/261, 262; 73/514, 517 R

[56] References Cited

UNITED STATES PATENTS

| | | | |
|---|---|---|---|
| 2,793,260 | 5/1957 | Ciosek | 200/61.45 R |
| 2,881,276 | 4/1959 | Mintz et al. | 200/61.45 R |
| 3,531,605 | 9/1970 | Schrichte | 200/61.45 R |
| 3,631,804 | 1/1972 | Anderson et al. | 200/61.48 X |
| 3,673,362 | 6/1972 | Carlson et al. | 200/61.45 R |
| 3,686,534 | 8/1972 | Cook, Jr. | 200/61.48 UX |
| 3,731,019 | 5/1973 | Heurtebise | 200/61.45 R |

*Primary Examiner*—James R. Scott

*Attorney, Agent, or Firm*—Wooster, Davis & Cifelli

[57] ABSTRACT

An omnidirectional inertia switch comprises a conductive spherical seismic mass supported concentric with respect to a stationary spherical conductor by a spherical elastomeric suspension member which deforms under inertial loads and permits electrical contact between the seismic mass and the stationary conductor to provide a signal. In one embodiment, the stationary spherical conductor is positioned centrally in a spherical cavity. The spherical seismic mass is hollow and surrounds the stationary spherical conductor. The elastomeric suspension member is positioned between the surface of the spherical cavity and the outside surface of the spherical seismic mass. In another embodiment, the spherical seismic mass is positioned within a spherical cavity defined in a housing, and the elastomeric suspension member is positioned therebetween and includes a plurality of openings permitting contact therebetween.

10 Claims, 7 Drawing Figures

Fig. 1.
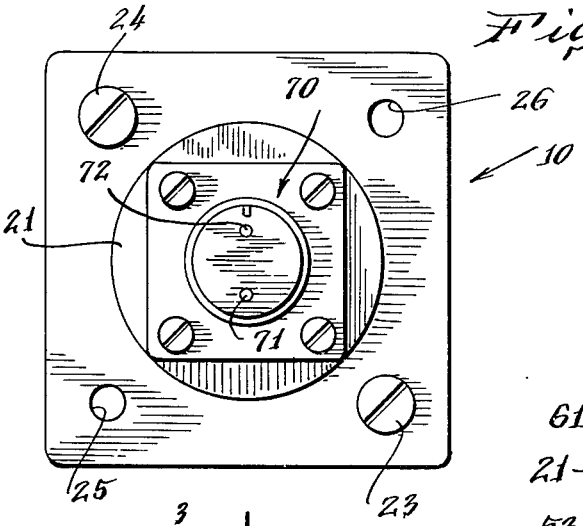
Fig. 2.
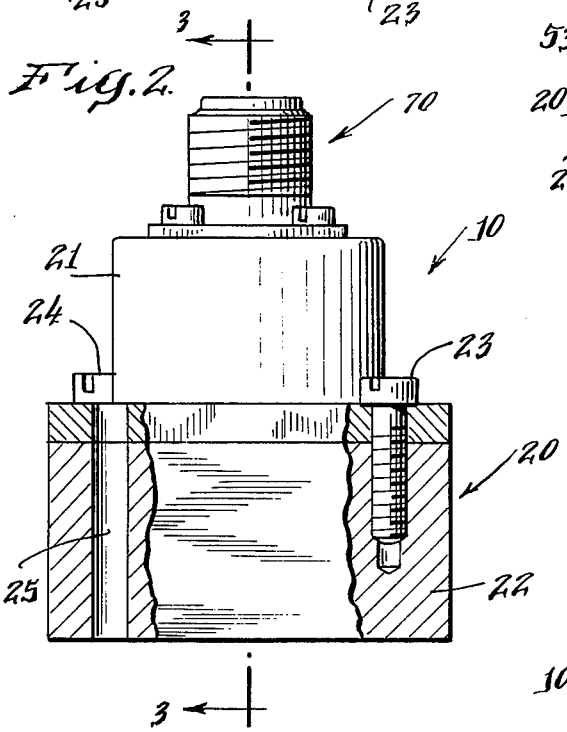
Fig. 3.
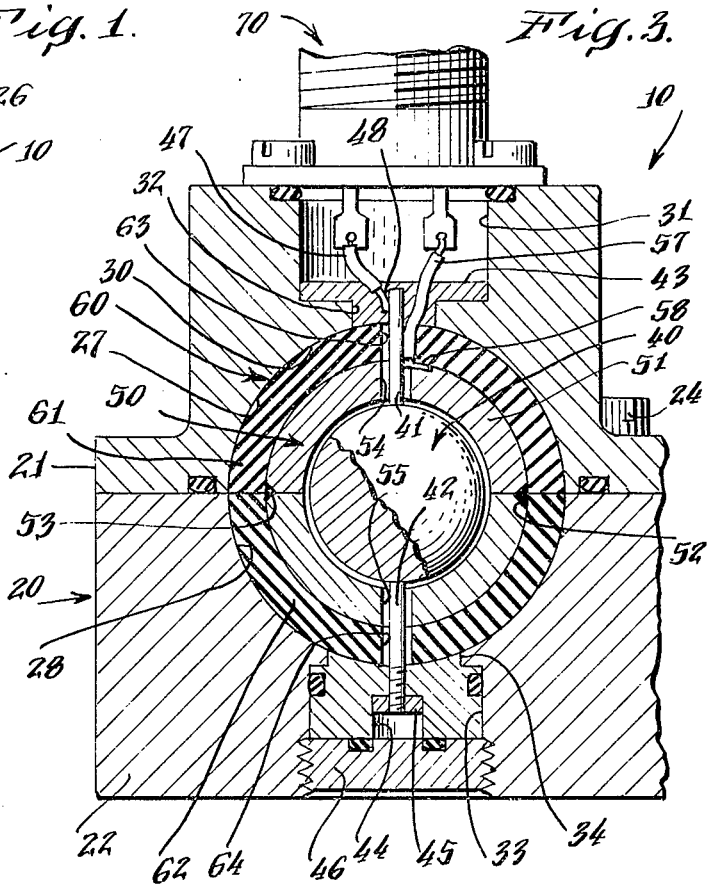
Fig. 4.
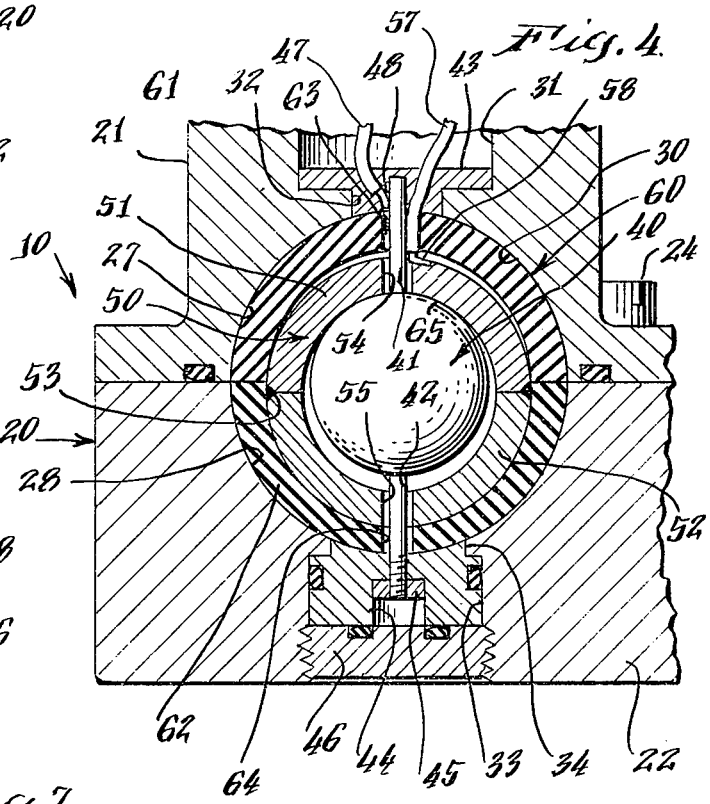
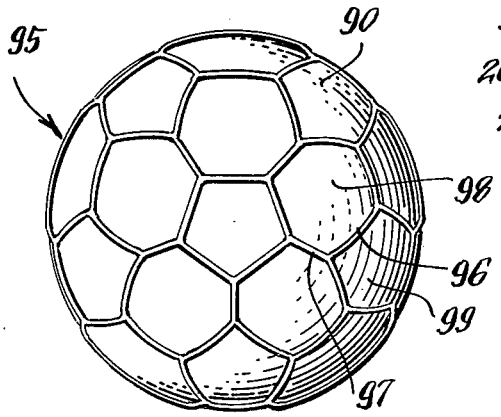
Fig. 7.

OMNIDIRECTIONAL INERTIA SWITCH

BACKGROUND OF THE INVENTION

This invention relates to an omnidirectional inertia switch which is uniformly activated by a given inertial loading regardless of the orientation of the inertial loading with respect to the switch.

Inertia switches which are operative in one mode or axis are well known. They generally comprise a mass connected to a spring aligned with the desired axis of operation. The mass is displaced against the spring by acceleration or deceleration inertial loads, and the displacement of the mass or tension created in the spring operates switch means or other means indicating that a given inertial load has been applied to the inertia switch.

The development of three dimensional inertia switches, however, has not heretofore reached a satisfactory level. A common approach to the problem of an inertia switch operable in three dimensions builds on the technology discussed in the foregoing paragraph, and consists of suspending a seismic mass on a plurality of springs arranged along the orthogonal X — Y — Z axes. Such inertia switches achieve fairly good results in response to inertial loads which are applied along one of the orthogonal axes; however, such devices do not achieve proper summation of forces in all directions, and therefore, true spherical or omnidirectional response is unattainable in such inertia switches.

SUMMARY OF THE INVENTION

Inertial switches according to the invention herein achieve a uniform, omnidirectional response to inertial loads by utilizing a conductive spherical seismic mass, comprising one terminal of an electrical contact switch, and a concentric stationary spherical conductor comprising the other terminal of the electrical contact switch. In one embodiment, the stationary spherical conductor is positioned inside and is surrounded by a hollow conductive spherical seismic mass. The seismic mass is in turn surrounded by a resilient, elastomeric suspension member which supports the seismic mass a given distance away from the stationary conductor in the absence of an inertial load. An inertial load causes the seismic mass to deform the suspension member, and if the inertial load is of a sufficient given strength, causes the seismic mass to make contact with the stationary conductor, thereby providing a signal indicative that a given inertial load is being applied to the switch.

In a second embodiment of the omnidirectional inertia switch a conductive spherical seismic mass, comprising one terminal of an electrical contact switch, is positioned within a hollow concentric stationary spherical conductor, which comprises the other terminal of the electrical contact switch. A resilient elastomeric suspension member comprises a network of thin webs which define relatively large openings, and the suspension member is interposed between the seismic mass and the concentric stationary conductor. Upon application of a given inertial load the seismic mass compresses the webs and causes the seismic mass to contact with the stationary conductor through one of the openings defined by the webs.

Thus, through the use of a spherical seismic mass and a concentric spherical stationary conductor, uniform response to an inertial load is achieved regardless of the direction of the inertial load with respect to the inertia switch. Of course, uniform response to inertial loads in two dimensional applications is readily achievable through the use of a cylindrical seismic mass and concentric cylindrical stationary conductor.

OBJECTS OF THE INVENTION

It is a principal object of the invention to provide an inertia switch with uniform response to inertial loads regardless of the directions thereof.

It is another object of the invention to provide an inertia switch with uniform response to inertial loads regardless of the directions thereof wherein the inertia switch is comprised of a limited number of parts and is substantially trouble free in operation.

It is a further object of the invention to provide an inertia switch with uniform response to inertial loads regardless of the directions thereof wherein the inertia switch is rugged and unaffected by repeated applications of inertial loads, including impacts.

Other and more particular objects of the invention will in part be obvious and will in part appear from a perusal of the following description of the preferred embodiments and the claims, taken together with the drawings.

DRAWINGS

FIG. 1 is a top view of an omnidirectional inertia switch according to the invention herein;

FIG. 2 is a side view, partially cutaway, of the omnidirectional inertia switch of FIG. 1;

FIG. 3 is an enlarged sectional view of the omnidirectional inertia switch of FIG. 1 taken along the lines 3—3 of FIG. 2;

FIG. 4 is another enlarged sectional view, similar to FIG. 3, of the omnidirectional inertia switch of FIG. 1 in its closed position;

FIG. 7 is a view of the suspension member of the omnidirectional inertia switch of FIG. 5.

The same reference numerals refer to the same elements throughout the various Figures.

DESCRIPTION OF PREFERRED EMBODIMENTS

Figure 5:
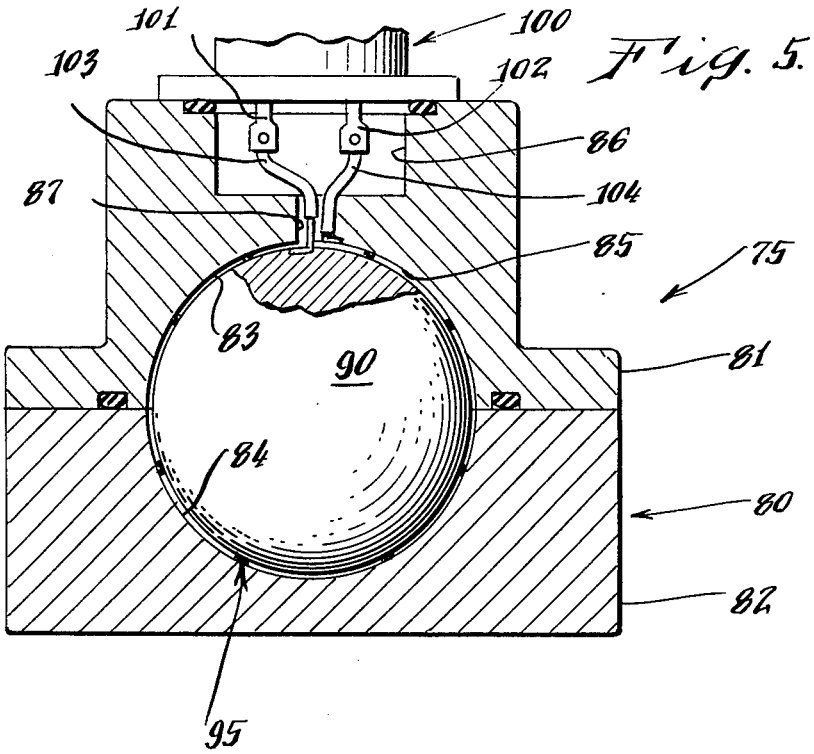
FIG. 5 is a sectional view of another omnidirectional inertia switch according to the invention herein.

Referring now to FIGS. 1 – 4, there is shown an omnidirectional inertia switch 10 which is a first embodiment of the invention herein. The omnidirectional inertia switch 10 generally comprises: a housing 20 which defines a spherical cavity 30 therein; a stationary spherical conductor 40 centrally positioned within the spherical cavity 30; and a hollow conductive spherical seismic mass 50 concentric with and supported spaced apart from the stationary spherical conductor 40 by a hollow elastomeric spherical suspension member 60 positioned between the seismic mass 50 and the surfaces of the housing 20 defining the spherical cavity 30. The stationary conductor 40 and the seismic mass 50 each comprises one terminal of the omnidirectional inertia switch 10. When an inertial load is applied to the omnidirectional inertia switch 10, as illustrated in FIG. 4, the seismic mass 50 deforms the elastomeric suspension member 60. If the inertial load is of sufficient magnitude, the seismic mass 50 makes contact with the stationary conductor 40 to close the switch, as shown at 65, thus indicating that a given inertial load has been applied to the omnidirectional inertia switch.

More particularly, the housing 20 of the omnidirectional inertia switch 10 comprises an upper half 21 and a lower half 22 which are secured together by bolts 23 and 24. Openings 25 and 26 are provided through the housing 20 for attaching it with bolts to an aircraft or other device, the inertial loads upon which are to be monitored. The upper and lower housing halves 21 and 22 have, respectively, generally hemispheric concave surfaces 27 and 28 which cooperate to define the spherical cavity 30.

The upper housing half 21 further defines a cylindrical cavity 31 which connects with the spherical cavity 30 through an opening 32. Similarly, a generally cylindrical cavity 33 is formed in the lower housing at 22, and cavity 33 connects with the spherical chamber 30 through an opening 34.

The stationary spherical conductor 40 is supported centrally within the spherical cavity 30 on two posts 41 and 42, which are aligned along an axis of the stationary spherical conductor 40. Post 41, which is fabricated of an electrically conductive material, is slideably received in a header 43 which is press fit or otherwise retained in the cylindrical cavity 31 of housing half 21. The header 43 includes a portion which substantially fills the opening 32 connecting the spherical chamber 30 and cylindrical chamber 31, and the lower surface of header 43 is preferably curved to define the spherical chamber 30 in the area of opening 32. Post 42 is threadably mounted in a header 44, which is in turn received in the cylindrical opening 33 in the lower housing half 22. The stationary spherical conductor 40 can be adjusted to a central position within spherical cavity 30 by turning the post 42, and when the proper position is attained, the post 42 can be secured by a lock nut 45. A closure plug 46 is threaded into the outer portion of the cylindrical opening 33 to retain the header 44 in housing half 22.

The seismic mass 50 is formed in two halves 51 and 52, each comprising substantially a hollow hemisphere, which are joined together by welding, as indicated at 53. The halves 51 and 52 are provided, respectively, with openings 54 and 55 through which pass the posts 41 and 42. The seismic mass 50 is fabricated from two halves so that it can be assembled about the stationary spherical conductor 40.

The deformable elastomeric suspension member 60 is also formed in two parts 61 and 62, each comprising substantially a hollow hemisphere. The suspension member halves 61 and 62 are respectively provided with openings 63 and 64 which permit posts 41 and 42 to pass therethrough. The suspension member 60 is matingly received within the spherical cavity 30, and the spherical seismic mass 50 is matingly received within the suspension member 60.

The stationary spherical conductor 40 and the seismic mass 50 comprise the terminals of the omnidirectional inertia switch 10. Accordingly, the stripped end of an insulated wire conductor 47 is soldered to post 41 as indicated at 48. A second insulated wire conductor 57 passes through an opening in header 43 and the opening 63 in suspension member 60, and the stripped end thereof is soldered to the seismic mass 50 as indicated at 58. A plug connector receptacle 70 is mounted over and closes the cylindrical cavity 31 in the upper half 21 of housing 20. The plug connector receptacle 70 comprises two terminal pins 71 and 72, and the wire conductors 47 and 57 are connected to the terminal pins 71 and 72 within cavity 31. As best seen in FIG. 1, the upper ends of terminal pins 71 and 72 are available for connection with a power source and indicator means, not shown, such that contact between conductive seismic mass 50 and the stationary spherical conductor 40 causes the indicator means to operate.

The omnidirectional inertia switch 10 is shown in FIG. 3 with no inertial load being applied thereto, and the suspension member 60 maintains the seismic mass 50 spaced apart from the stationary spherical conductor 40. Upon application of an inertial load the seismic mass 50 deforms the elastomeric suspension member 60, and when the inertial load is of sufficient magnitude, the seismic mass 50 contacts the stationary spherical conductor 40 to close the switch, as shown at 65 in FIG. 4.

It will be apparent that the omnidirectional inertia switch 10 is equally responsive to inertial loads regardless of the direction or orientation of the force vector of such inertial loads. There may be a slight deviation from absolutely spherical response caused by the openings 63 and 64 in the suspension member 60 and the openings 54 and 55 in the seismic mass 50, but the deviation is negligible.

The factors determining the magnitude of an inertial load which will cause the omnidirectional inertia switch 10 to close are: (1) the radial dimensions of the seismic mass 50 and the stationary spherical conductor 60, which determine the gap therebetween; (2) the mass of the seismic mass 50; and (3) the durometer of the elastomeric suspension member 60. It will be apparent that the omnidirectional inertia switch 10 can be made to operate in response to any given magnitude of inertial load by varying any one or more of these factors.

Figure 6:
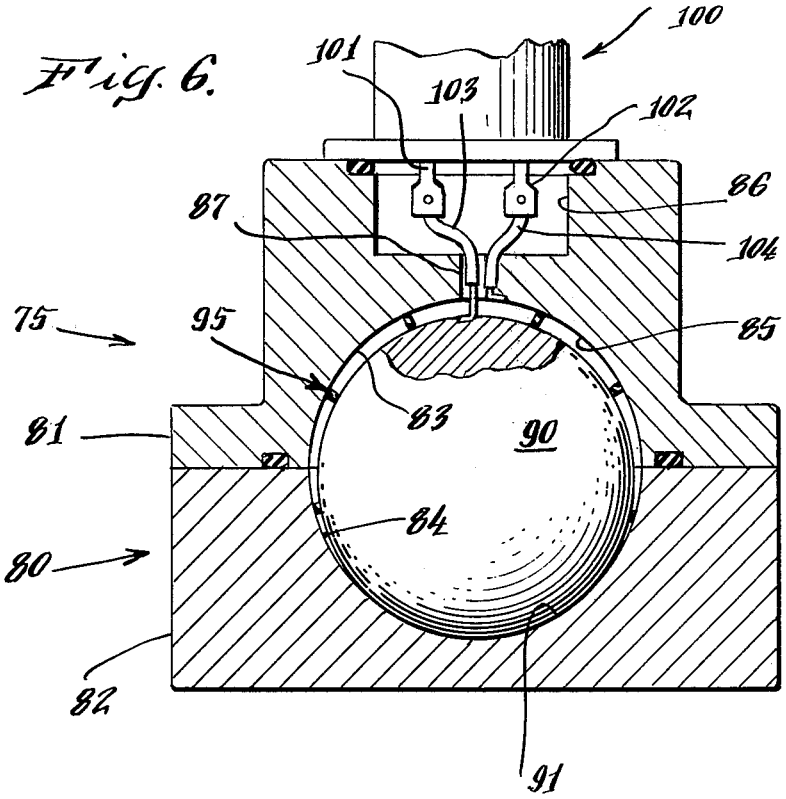
FIG. 6 is a sectional view of the omnidirectional inertia switch of FIG. 5 in its closed position.

Referring now to FIGS. 5 and 6, an omnidirectional inertia switch 75 comprising a second embodiment of the invention herein is shown. The omnidirectional inertia switch 75 generally comprises a housing 80 defining a spherical cavity 85 in which a spherical seismic mass 90 is centrally supported by means of an elastomeric suspension web 95. The seismic mass 90 and the interior surface of the spherical cavity 85 are conductive and serve as the two terminals of the omnidirectional inertia switch, which closes by means of contact therebetween upon application of an inertial load of sufficient magnitude.

Referring more particularly to FIGS. 5 and 6, the housing 80 comprises upper and lower halves 81 and 82 which have, respectively, concave hemispherical surfaces 83 and 84 which cooperate to define the spherical cavity 85. The housing portions 81 and 82 are held together by bolts or other suitable means, not shown. The entire housing 80 may be made of conductive material, or the surfaces defining the spherical cavity 85 may be plated with a conductive material.

The upper housing half 81 has a generally cylindrical cavity 86 formed therein which connects with the spherical cavity 85 through an opening 87. A plug connector receptacle 100 comprising terminal pins 101 and 102 is attached to the housing 80 and closes the cylindrical cavity 86. Terminal pin 101 is connected to the conductive surface of the spherical seismic mass 90 by an insulated wire conductor 103, which passes through opening 87. Terminal pin 102 is connected to the conductive surface of the housing wall defining the spherical cavity 85 by a second insulated wire conductor 104. The terminal pins 101 and 102 are connected into a circuit including a power source and indicator means such that the indicator means is operated upon closure of the omnidirectional inertia switch 75. If the entire housing 80 is conductive, the second insulated wire conductor 104 may be connected to the housing at any point, or may be deleted entirely, wherein the housing can be used as the ground in the electrical circuit.

Referring particularly to FIG. 7, the elastomeric suspension web 95 is shown surrounding the spherical seismic mass 90. The suspension web 95 comprises a plurality of individual webs, such as webs 96 and 97, which are integrally joined together to define a plurality of openings, such as openings 98 and 99. In the embodiment shown, the individual webs all have substantially the same dimensions and cooperate to define a plurality of regular equal sized hexagonal openings, such as opening 98, and regular equal sized pentagonal openings, such as opening 99.

The suspension web 95 may be injection molded about the spherical seismic mass 90, or may be fabricated separately. If it is sufficiently elastomeric, the spherical seismic mass 90 may be inserted into the suspension web 95 through one of the plurality of openings. Otherwise, one or more of the individual webs may be cut to permit insertion of the spherical seismic mass 90 and be rejoined thereafter.

Referring again to FIG. 5, the suspension web 95 centrally supports the spherical seismic mass 90 within the spherical cavity 85 when no inertial load is applied to the omnidirectional inertia switch 75. As best seen in FIG. 6, when an inertial load is applied to the omnidirectional inertia switch 75, the suspension web 95 is deformed, and if the inertial load is of sufficient magnitude, the seismic mass 90 touches the surface of the spherical cavity to close the switch, as indicated at 91. Although the suspension web 95 illustrated does not comprise a perfect distribution of elastomeric material about the seismic mass 90, the deviation from perfect uniform response to inertial loads from an direction is negligible.

The omnidirectional inertia switch 75 may be set to close in response to inertial loads of varying magnitudes by selection of the thickness and durometer of the suspension web 95, and by selection of the mass of the seismic mass 90.

As noted above, the omnidirectional inertia switches described herein are particularly well adapted for use in aircraft or other devices which are subjected to inertial loads of varying orientation, and the omnidirectional inertia switches respond equally to a given inertial load regardless of their orientation. The omnidirectional inertia switches according to the invention herein comprise a small number of parts, and are extremely rugged and trouble free in operation.

It will be apparent to those skilled in the art that various changes and modifications to the preferred embodiments described herein can be made without departing from the spirit and scope of the invention, which is limited only by the following claims.

I claim:

1. An omnidirectional inertia switch for sensing inertial loads on an object comprising:

A. a member having a spherical surface, said member mounted stationary with respect to the object on which inertial loads are to be sensed;

B. a spherical seismic mass adapted to be positioned concentrically with respect to the spherical surface of said stationary member;

C. a deformable elastomeric suspension member surrounding said spherical seismic mass and supporting it concentrically with respect to the spherical surface of said stationary member, said suspension member having substantially uniform deformability about said spherical seismic mass; and D. means for sensing contact between said spherical seismic mass and the spherical surface of said stationary member, whereby the application of an inertial load on the object causes relative movement of said spherical seismic mass toward the spherical surface of said stationary member, and if the inertial load is sufficiently large, causes contact therebetween.

2. An omnidirectional inertia switch as defined in claim 1 wherein the spherical surface of said stationary mounted member defines a spherical cavity within said stationary mounted member, and said spherical seismic mass is positioned within said spherical cavity.

3. An omnidirectional inertia switch as defined in claim 2 wherein said deformable suspension member is interposed between the spherical surface of said stationary mounted member and said spherical seismic mass and includes a plurality of openings substantially uniformly arrayed about said spherical seismic mass through which said spherical seismic mass contacts the spherical surface of said stationary mounted member upon application of a sufficiently large inertial load.

4. An omnidirectional inertia switch as defined in claim 1 wherein said spherical seismic mass is hollow and surrounds the spherical surface of said stationary mounted member.

5. An omnidirectional inertia switch comprising:

A. a housing defining a spherical cavity therein, said housing being adapted for mounting to an aircraft or the like upon which inertial loads are to be sensed;

B. a spherical conductor supported stationary with respect to said housing and centrally with respect to the spherical cavity defined therein;

C. a hollow conductive spherical seismic mass positioned within the spherical cavity defined by said housing, said spherical seismic mass surrounding said spherical conductor;

D. a hollow spherical elastomeric suspension member positioned between said spherical seismic mass and the surface of the spherical cavity defined in said housing, said elastomeric suspension member 1. supporting said spherical seismic mass concentric with respect to said stationary conductor in the absence of an inertial load,
2. deformed by said spherical seismic mass upon application of an inertial load, and
3. permitting said spherical seismic mass to contact said spherical conductor upon application of a given inertial load;

E. means connecting said spherical conductor and said seismic mass in an electrical circuit providing a signal upon contact therebetween.

6. An omnidirectional inertia switch as defined in claim 5 wherein said spherical conductor is supported on at least one post mounted to said housing, and wherein said spherical seismic mass and said spherical suspension member define openings through which said post extends.

7. An omnidirectional inertia switch as defined in claim 6 wherein said housing is formed in two portions which are secured together and each of which includes a header partially defining the spherical cavity, and said spherical seismic mass is supported on two posts aligned along an axis of said spherical seismic mass and received in said headers, one of said posts slideably received in one of said headers and the other of said posts adjustably received in the other of said headers for adjusting the position of said spherical seismic mass in the cavity.

8. An omnidirectional inertia switch comprising:

A. a housing defining a spherical cavity therein wherein at least the surface of said housing defining the spherical cavity is conductive, said housing being adapted for mounting to an aircraft or the like upon which inertial loads are to be sensed;

B. a conductive spherical seismic mass positioned within the cavity defined by said housing;

C. a hollow elastomeric suspension member positioned between said spherical seismic mass and the surface of the spherical cavity defined in said housing, said elastomeric suspension member 1. supporting said spherical seismic mass concentric with respect to the surface of the spherical cavity defined in said housing in the absence of an inertial load,
2. deformed by said spherical mass upon application of an inertial load, and
3. defining a plurality of openings substantially uniformly arrayed about said spherical seismic mass through which said spherical seismic mass contacts the surface of the spherical cavity defined in said housing upon application of a sufficiently large inertial load; and D. means connecting said spherical seismic mass and the surface of the spherical cavity defined in said housing in an electrical circuit providing a signal upon contact therebetween.

9. An omnidirectional inertia switch as defined in claim 8 wherein said elastomeric suspension member comprises a plurality of integrally interconnected web segments defining a plurality of regular polygonal openings.

10. An omnidirectional inertia switch as defined in claim 9 wherein said plurality of regular polygonal openings comprise a plurality of regular hexagonal openings and a plurality of regular pentagonal openings.

* * * * *